US006855062B1

(12) United States Patent
Truong

(10) Patent No.: US 6,855,062 B1
(45) Date of Patent: Feb. 15, 2005

(54) RECONFIGURABLE MAZE

(76) Inventor: Ken Truong, 2223 W. 7th St., Brooklyn, NY (US) 11223

( * ) Notice: Subject to any disclaimer, the term of this patent is extended or adjusted under 35 U.S.C. 154(b) by 0 days.

(21) Appl. No.: 10/446,212

(22) Filed: May 27, 2003

(51) Int. Cl.[7] ..... A63J 11/00
(52) U.S. Cl. ..... 472/62; 472/136; 472/134
(58) Field of Search ..... 472/62, 136; 273/287, 273/275, 276, DIG. 31; 52/111, 115

(56) References Cited

U.S. PATENT DOCUMENTS

| | | | | |
|---|---|---|---|---|
| 496,604 A | | 5/1893 | Guth | |
| 545,678 A | | 9/1895 | Castan | |
| 760,032 A | | 5/1904 | Snedeker | |
| 4,154,440 A | | 5/1979 | Rusk | |
| 5,046,720 A | | 9/1991 | Bolly | |
| 5,219,316 A | * | 6/1993 | Huffman | 472/62 |
| 5,364,311 A | * | 11/1994 | Chou | 472/62 |
| 5,499,815 A | | 3/1996 | Attaya | |
| 5,572,835 A | * | 11/1996 | Atkins et al. | 52/111 |
| 5,809,708 A | | 9/1998 | Greer et al. | |
| 5,855,371 A | | 1/1999 | Sanders | |
| 5,906,373 A | | 5/1999 | Sanders | |
| 5,971,830 A | * | 10/1999 | Tobin | 446/256 |
| 6,257,575 B1 | * | 7/2001 | Ortega | 273/241 |
| 6,494,005 B2 | * | 12/2002 | Zimmerman | 52/296 |
| 6,675,538 B2 | * | 1/2004 | Candio | 52/65 |

FOREIGN PATENT DOCUMENTS

JP 05115625 A * 5/1993 ..... A63K/3/00

* cited by examiner

*Primary Examiner*—K. T. Nguyen
(74) *Attorney, Agent, or Firm*—Michael I. Kroll

(57) ABSTRACT

A reconfigurable maze comprising a plurality of columns positioned on a plurality of corresponding hydraulic lifts. Each hydraulic lift is connected to a respective column for moving the column between a raised position and a lowered position. Columns in the lowered position form a floor of the maze while columns in the raised position form walls of the maze and define paths through the maze. The maze may be reconfigured by selectively raising and lowering the columns. The columns may be manually or automatically performed by a central processor. The maze can be used to play hide and seek and predator and prey games.

12 Claims, 13 Drawing Sheets

RECONFIGURABLE MAZE

BACKGROUND OF THE INVENTION

1. Field of the Invention

The present invention relates generally to maze apparatus and, more specifically, to a changeable maze apparatus designed for use with a predator and prey game. The maze of the present invention embodies a plurality of substantially upright partitions that are raised and lowered to create the walls and paths of the maze.

2. Description of the Prior Art

Numerous maze apparatus designed for recreation have been provided in prior art. For example U.S. Pat. Nos. 496,604; 545,678; 760,032; 4,154,440; 5,046,720; 5,364,311; 5,499,815; 5,809,708; 5,855,371; 5,906,373; and 5,971,830 are all illustrative of such prior art. While these recreational maze apparatus may be suitable for the purposes for which they were designed, they would not be as suitable for the purposes of the present invention, as hereinafter described.

This invention relates to improvements in that class of buildings known as labyrinths, and which are provided with a series of complicated passages; and the object is to provide amusement and numerous novel complications.

The primary object of this invention is to provide such an arrangement of mirrors in a room or enclosure as shall cause them, by their reflection of objects suitably located with relation to the mirrors, to present to the vision of a person in the apartment the illusion of a labyrinthian device composed of seemingly endless passages, which appear to him to be freely traversable until he is stopped in his course by an obstructing mirror, from which long passages seem to extend to the right and to the left.

This invention relates to improvements in that class of buildings known as labyrinths and has for its object to provide an extensive and durable structure of this character particularly designed for erection and used in parks and other public places as an amusement device.

A maze apparatus adapted for use as a walk-through recreational facility. The apparatus includes a supporting surface carrying a plurality of substantially upright partitions which serve to define the maze course having a plurality of interconnected pathways along which movement of persons through the maze is restricted. Persons enter the course through an entrance opening into one of the pathways and progress along a bewildering array of interconnected pathways to gain egress from the apparatus course through a suitable exit. The partition panels can readily be arranged for rescheduling the maze course, which includes a predetermined shortest route having vital sections which must be traversed in order to reach the exit. A platform is provided in one embodiment which enables spectators standing thereon to view indicia carried by patrons walking through the maze apparatus to the end that the spectators can assist in directing the patrons along the pathways leading to the exit.

An amusement maze is located inside of a building and defines a labyrinth walking path. The maze is formed by upright flexible panels which are appropriately arranged in selected longitudinally and laterally extending patterns. The panels are supported by ropes anchored to a single sidewall of the building and are suspended above the floor of the building by wires which extend upwardly to the ceiling.

A collapsible labyrinth is constructed with a plurality of collapsible separating boards temporarily secured by vertical pivotal posts, two horizontal bars respectively on and under a line of separating boards to secure upper and lower ends of the pivotal posts, and tenons fitting in a mortise in a lower end of each separating board and also in one of tenon holes present in the ground for securing temporality each separating board so that the boards can be altered in position to make up a labyrinth route.

A maze unit containing a user-defined maze path and a ball or marble movable there through is disclosed. In one aspect, the top of the maze unit, or part of it, is covered so that the user relies upon verbal instructions provided by a second person who is familiar with or has recorded the internal maze path as to the direction in which to tip or tilt the unit so that the ball or marble follows the correct path to a predetermined exit. In one embodiment two or more maze units are stacked, one on top of the other, with aligned exit and entry holes so that a ball or marble that successfully traverses an upper unit falls into an entry point of a lower unit. In another aspect two or more maze units are interconnected end-to-end on the same level. Methods are disclosed for the use of such mazes in a variety of didactive scenarios.

An integrated prefabricated furniture is provided for finishing or fitting-out open plan building spaces, such as for offices, classrooms, hotels/motels, conference centers, medical treatment facilities, etc. A demountable architectural wall system covers the fixed walls of the building room, a portable partition wall system defines the interior space into individual work settings, and a demountable movable wall system forms custom width partitions. The three wall systems are completely compatible and fully integrated in both function and appearance, and provide similar utility raceways at common heights, as well as interchangeable cover panels. A modular column cover system selectively covers the support columns in the building room, and provides vertical utility routing and storage that integrates with the raceways in the wall systems. Pre-assembled facades, the freestanding storage case system, a space frame system, a prefabricated low raised floor construction, a modular overhead link head system, and accessories are disclosed and are designed to be used anywhere throughout the furniture system, and to serve to personalize the various individual work settings to accommodate specific users and tasks. Advantageously, the furniture system is readily reconfigurable.

A water targeting game (10), known as WATER TAG™. The game (10) consists of three major elements: a targeting vest (12), a water gun (140) and an obstruction maze (142) wherein the game is played. The targeting vest (12) includes a front vest (14) and a back vest (16) that are joined together at their upper peripheral edge (26) by a pair of adjustable shoulder straps (70) and that are adjusted at a person's waist by a pair of waist straps (74,76). Between the two vests is a cavity (56) and on the front section (42) of the vest, is located a plurality of water collecting openings (58) that serve as targets. When playing the game, the water gun emits a stream of water that is aimed at the openings (58) from where the water falls into the cavity (56). The water collected in the cavities (56) is viewed through a sealed vertical window (62) that is also located on the vest's front section (42). A WATER TAG™ game (10) that consists of a maze structure (14) having an outer perimeter wall (16) enclosing a plurality of sections (20,22,24,26) and protrusions (40). An opening (36) admits players armed with water guns (12) into the maze structure (14). Once inside the players circulate among the sections (20,22,24,26) and the protrusions (40), firing their water guns (12) at each other. The maze structure

(14) is inflated when the WATER TAG™ game is being played and can be deflated for storage and transportation.

A constructable spinning top maze kit having a base upon which rail pieces may be removably mounted to form a maze through which the spinning top may travel when launched from a launcher. Multiple bases may be joined together in a single plane to create an indefinitely-extendable maze, or multiple bases may be assembled in multiple planes to create an indefinitely-extendable multi-level maze. Because rail pieces are removably mounted on the base pieces, a maze may be disassembled and reconstructed to form another maze have a completely different geometry, or one or more rail pieces may be repositioned to less drastically alter the geometry of the maze. As with the rail pieces, the launcher may be removably mounted on the base pieces. Therefore, the launcher may be positioned at a variety of locations in a maze, easily repositioned, and used within a variety of maze geometries. One or more pins may be placed on the base to provide a game with the objective of launching the top in a manner such that it will knock over the pins. The rail pieces may have downward-directed dowels with spacings which are integer multiples of a unit distance, and the base may have holes separated by the unit distance into which the dowels of the rail pieces may be inserted, thereby maximizing the number of rail configurations on the base.

SUMMARY OF THE PRESENT INVENTION

The present invention relates generally to maze apparatus and, more specifically, to a changeable maze apparatus designed for use with a predator and prey game. The maze of the present invention embodies a plurality of substantially upright partitions that are raised and lowered to create the walls and path of the maze.

The maze structure consists of two levels, the higher recreation maze level and a lower level for housing the hydraulic lifts that raise and lower the column partitions of the maze. The hydraulic lifts are controlled by a main computer that can change the maze design to any desired pattern. The maze configuration can be changed as frequently as desired.

Changing of the maze configuration is accomplished by lowering certain column partitions and raising others. When the column partitions are not lifted, i.e., the hydraulic lift is at its lowest height and the top surface of the column partition is housed in the lower maze level, the column partitions can safely serve as the floor at the second maze level. The raised column partitions serving to define the maze course create a plurality of interconnecting pathways along which movement of a person through the maze is restricted.

The inventive maze can be used for recreational games. One such game is a game of predator and prey where one team of players pursue the player or players of the opposite team. The players in pursuit to be known as the predator and the players being pursued to be known as the prey. Persons enter the maze through an entrance and progress along the maze course attempting to find an exit.

A primary object of the present invention is to provide a changeable maze apparatus designed to be played with a predator and prey game within the maze.

Another object of the present invention is to provide a changeable maze apparatus that is contained within a steel infrastructure embodying a plurality of substantially upright partitions that are raised and lowered to create the walls and path of said maze.

Yet another object of the present invention is to provide a changeable maze apparatus having two levels, a recreation maze level and a lower level housing the column shafts and hydraulic lifts that raise and lower column partitions.

Another object of the present invention is to provide a changeable maze apparatus where the hydraulic lifts are controlled by a main computer that can change the maze design to any desired pattern, changing the maze as frequently as desired.

Another object of the present invention is to provide a changeable maze apparatus where the maze is changed by lowering certain column partitions and raising others. When column partitions are not raised, the lift is at its lowest height and the column partitions can safely serve as the maze floor.

An even further object of the present invention is to provide a changeable maze apparatus where the maze is changed using hydraulic lifts to raise certain columns and lower others.

Additional objects of the present invention will appear as the description proceeds.

The present invention overcomes the shortcomings of the prior art by providing a changeable maze apparatus that is designed for use with a predator and prey game. The maze of the present invention is contained within a steel infrastructure having a plurality of substantially upright partitions that are raised and lowered to create the walls and paths of the maze. The structure consists of two levels, the recreation maze level and a lower level that houses the columns and hydraulic lifts that raise and lower the columns. These hydraulic lifts are controlled by a main computer that can change the maze design to any desired pattern as frequently as desired.

The column partitions, which serve to define the maze course, create a plurality of interconnecting pathways along which movement of a person through the maze is restricted. Persons enter the maze through an entrance and progress along the maze course to locate an exit. A vest is worn by the user who wishes to play the game designed for the maze thereby identifying the team for which the user plays. A player's vest generally contains a laser beam detector, a laser gun, and an electronic sensor tag.

The foregoing and other objects and advantages will appear from the description to follow. In the description reference is made to the accompanying drawing, which forms a part thereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
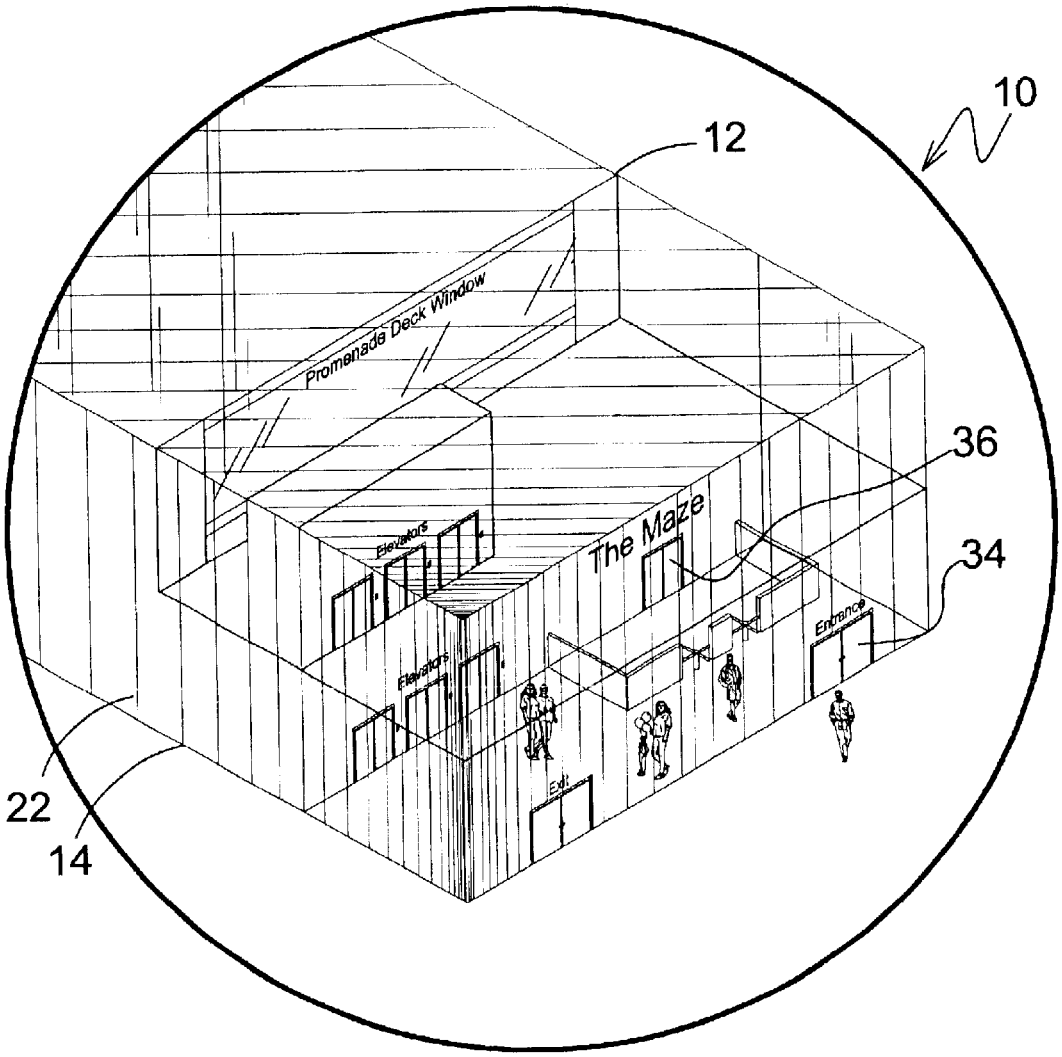
FIG. 1 is an illustrative view of the reconfigurable maze of the present invention.

Turning now descriptively to the drawings, in which similar reference characters denote similar elements throughout the several views, the Figures illustrate the reconfigurable maze of the present invention. With regard to the reference numerals used, the following numbering is used throughout the various drawing Figures.

10 reconfigurable maze of the present invention
12 steel infrastructure
14 steel floor grid
16 steel columns
18 column walls
20 column floor
22 main level
24 lower level
26 hydraulic lifts
28 rest area
30 promenade
34 general entrance
36 players' entrance
38 maze area
40 points emitter
42 button
44 directional lines
46 piston rod,
48 first piston
50 second piston
52 fluid containing cylinder
54 hydraulic pump
56 fluid
60 computer
62 computer operator
64 player's vest
66 electronic sensor tag
68 laser gun
70 laser beam detector
72 transmitter
74 headphones
76 microphones
78 points emitter power module
80 points emitter switch
82 points emitter microprocessor
84 points emitter transmitter
86 points emitter antenna
88 sensor tag power module
89 sensor tag comparator
90 sensor tag timer
92 sensor lag microprocessor
93 sensor tag display
94 sensor tag receiver
96 sensor tag antenna
93 sensor tag display
94 sensor tag receiver
96 sensor tag antenna

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 13 illustrate the reconfigurable maze of the present invention generally by the numeral 10.

Figure 3:
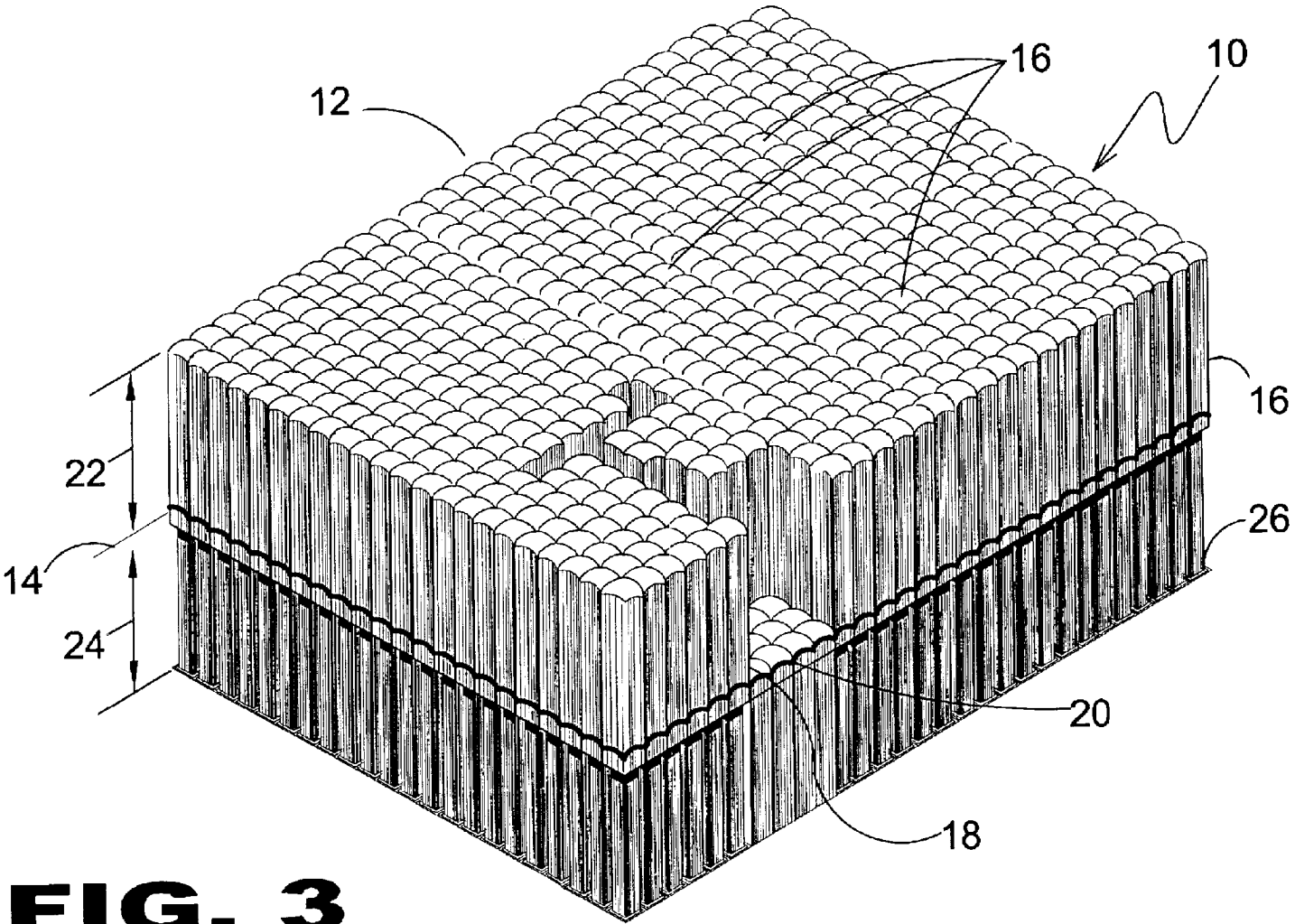
FIG. 3 is a perspective view of the hydraulic lift columns of the reconfigurable maze of the present invention.
Figure 11:
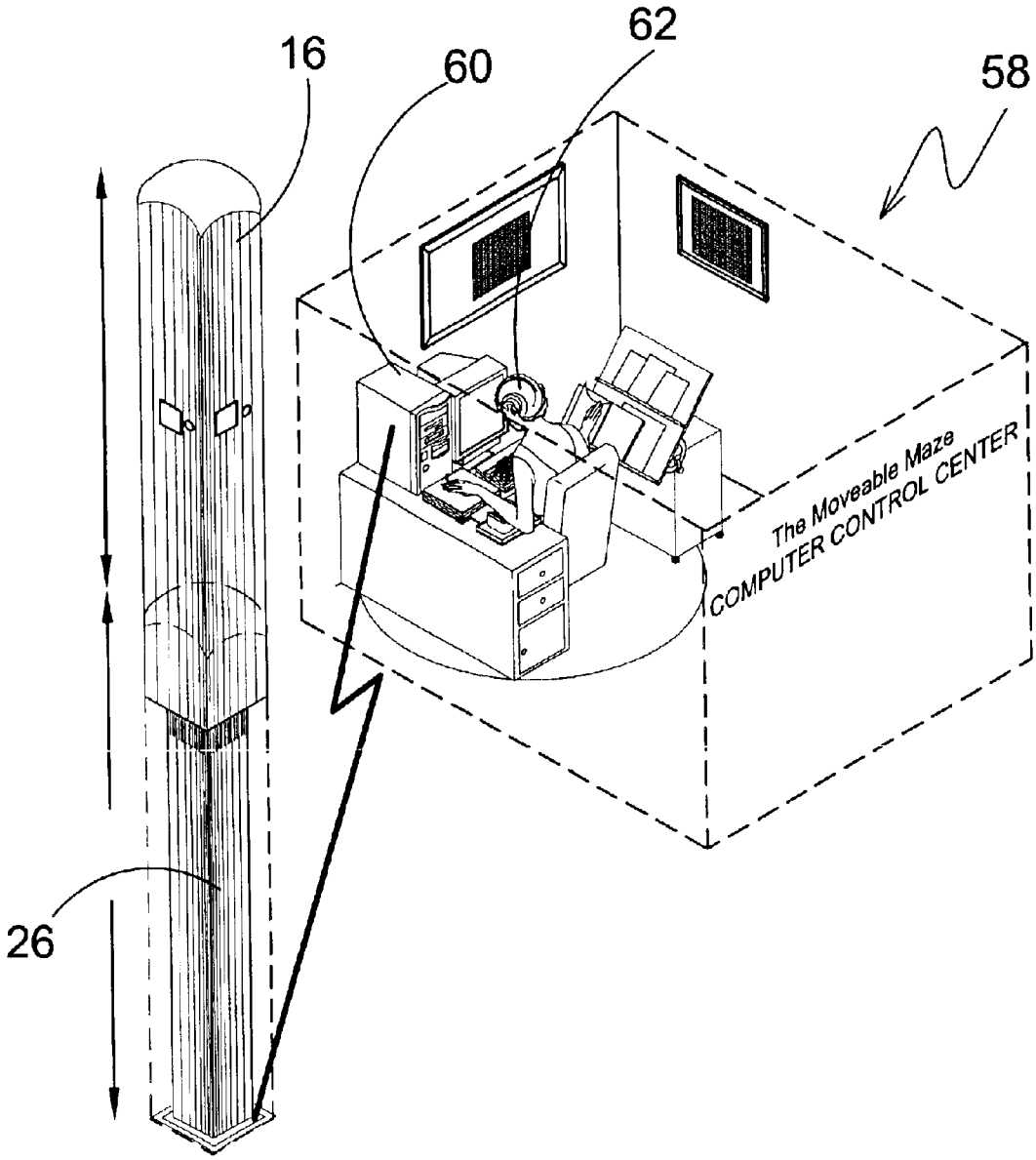
FIG. 11 is an illustrative view of a hydraulic lift column of the reconfigurable maze of the present invention operated from a computer control center.

FIG. 1 is an illustrative view of the maze housing 12 of the present invention. As shown in FIG. 3, the reconfigurable maze 10 of the present invention is contained within a steel infrastructure having a steel floor grid 14 comprised of steel columns 16. The steel columns 16 can selectively be moved from a lowered position forming a floor 20 of the maze to a raised position forming walls 18. The columns 16 are selectively moved using a program of steps executed by a computing device 60, as illustrated in FIG. 11. When the columns 16 are in the lowered position, they form the floor 20 of the maze 10. When the columns are in the raised position, they form the walls 18 of the maze 10 thereby defining a path through the maze 10.

When the steel columns 16 are moved into position for forming the walls 18, they are located on the main level 22. Beneath the main level 22 is a lower level 24 housing the hydraulic lifts 26, as shown in FIG. 3, that raise and lower the columns 16. A main computer 60 of the present invention, as illustrated in FIG. 11, controls operation of the hydraulic lifts 26. The computer 60 can control the hydraulic lifts 26 to raise and lower select columns 16 and thereby change the design of the maze 10 to produce any desired pattern. The hydraulic lifts 26 may be controlled to change the maze 10 as frequently as desired.

Figure 2:
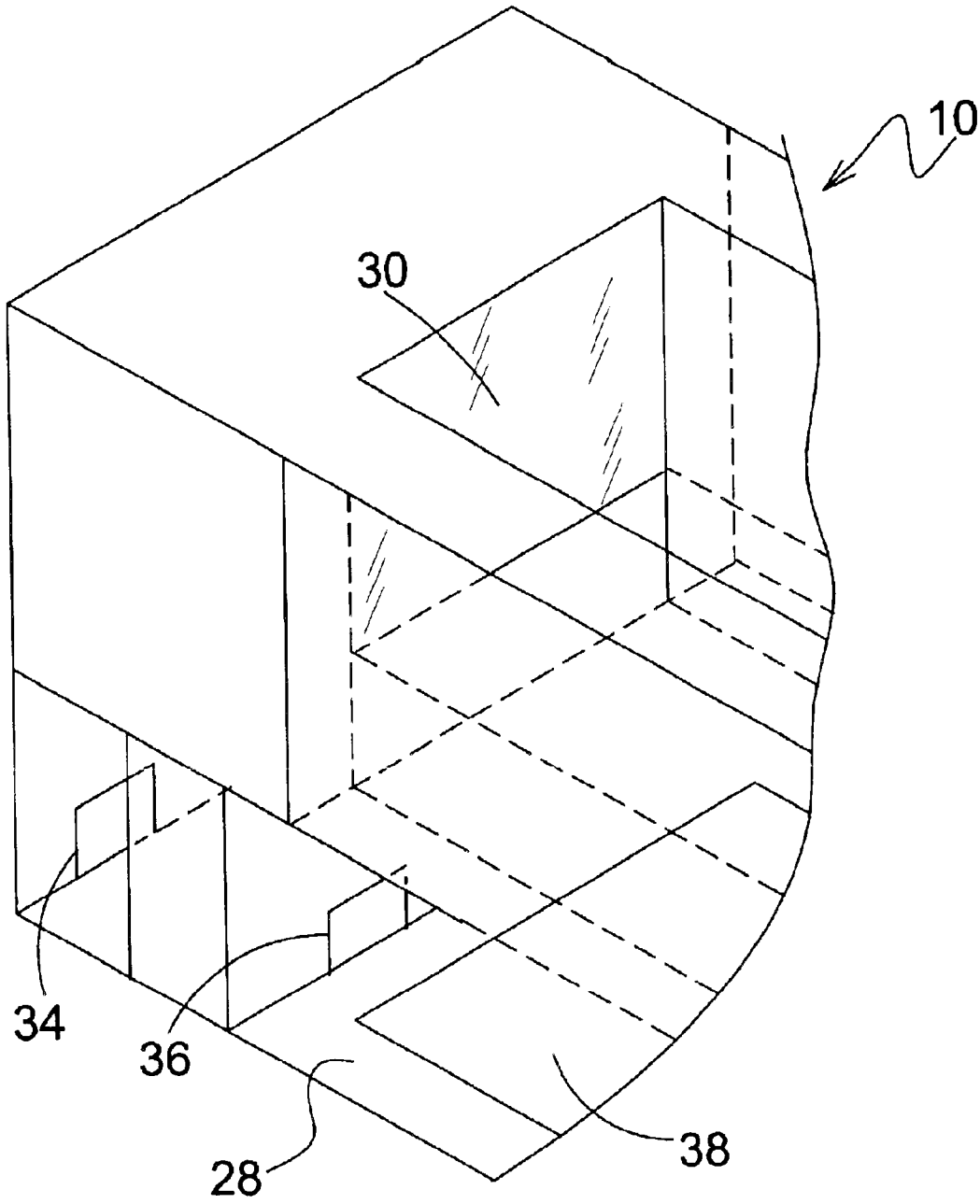
FIG. 2 is a perspective partial cross-sectional view of the reconfigurable maze of the present invention floor plan showing the maze level and lower level.

FIG. 2 is a perspective view of the floor plan showing the maze level 28 and the lower level 30 positioned on an underside of the reconfigurable maze 10. Players and viewers enter the maze area 38 through the general entrance 34, the players will proceed through a players' entrance 36 to the maze area 38, the viewers are directed to the promenade 30. From a vantage point above the maze area 38, the viewers are able to watch games unfolding below in the maze area 38, route for their team, and otherwise participate in the game.

FIG. 3 is a perspective view of the hydraulic lift columns of the present invention. Shown in this Figure are the main level 22 and the lower level 24. The main level 22 forms the maze area 38 and located within the lower level 24 on an underside of the main level are the hydraulic lifts 26. The lifts 26 are operated by a computer 60 and are raised and lowered to reconfigure the pattern of the maze.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 4:
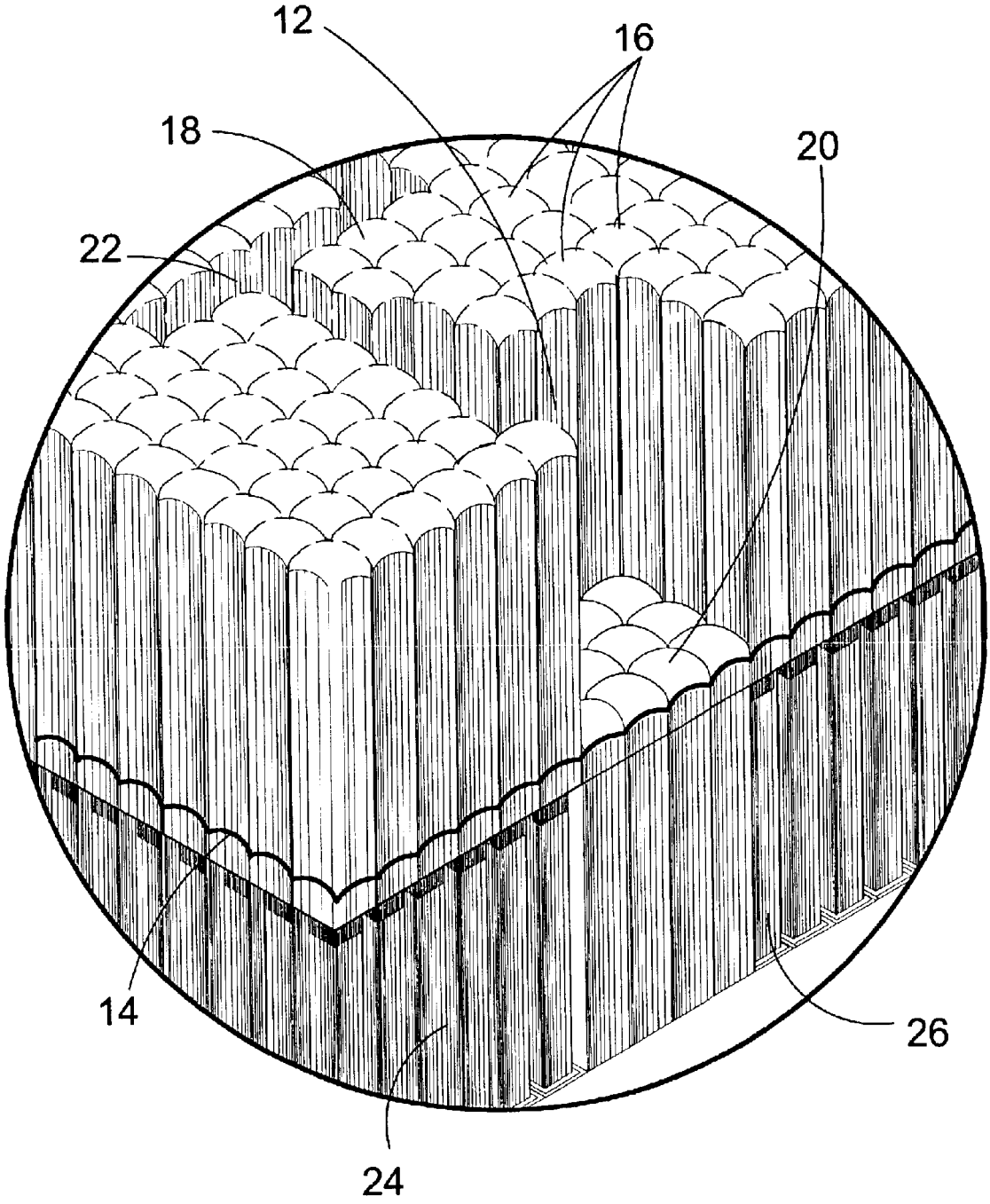
FIG. 4 is an enlarged perspective view of the hydraulic lift columns of the reconfigurable maze of the present invention in use.

FIG. 4 is a perspective view of the hydraulic lift columns of the present invention. The reconfigurable maze 10 of the present invention has of two levels, the main level 22 forms the maze room 38 and the lower level 24 within which the hydraulic lifts 26 are positioned. Different designs for the maze 10 can be accomplished by lowering selected columns 16 and raising others. When the columns 16 are not raised, the lift 26 is at its lowest height and the columns 16 safely serve as the floor 20.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 5:
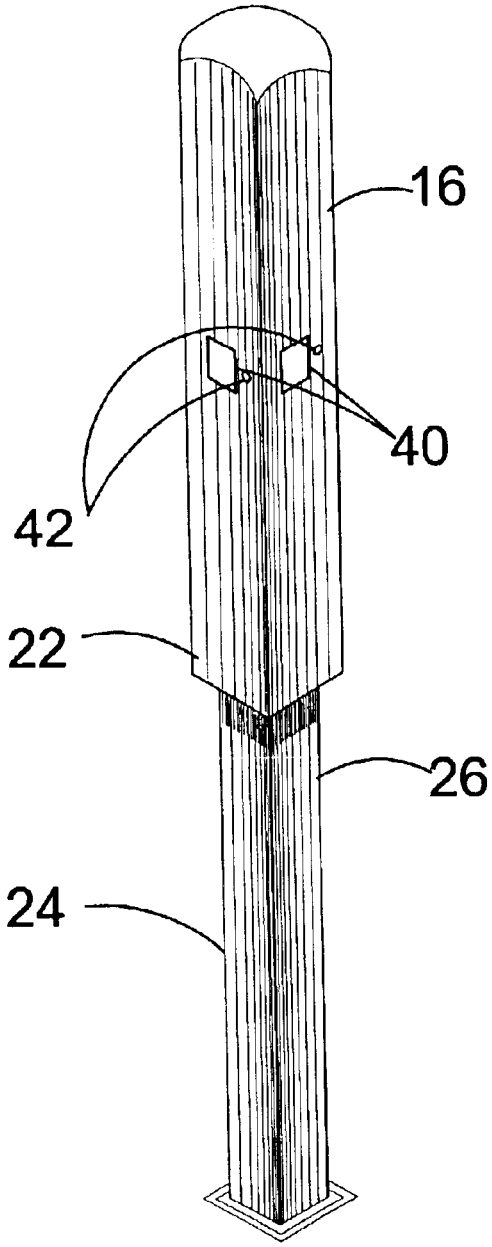
FIG. 5 is a perspective view of an individual hydraulic lift column of the reconfigurable maze of the present invention.

FIG. 5 is a perspective view of a column 16 of the present invention. Shown is the moveable maze column 16 and computer controlled hydraulic lift 26. The column 16 is positioned at the main level 22 within maze room 38. The lower level 24 includes hydraulic lifts 26. Different designs for the maze can be accomplished by lowering certain columns 16 and raising others. When the columns 16 are not raised, the lift 26 is at its lowest height and the columns can safely serve as the floor 20 of the maze. An electronic points emitter 40 and button 42 may be located on all four sides of the column 16. The use of the electronic points emitter 40 and button 42 will be discussed in more detail hereinafter with specific reference to FIGS. 12 and 13.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 6:
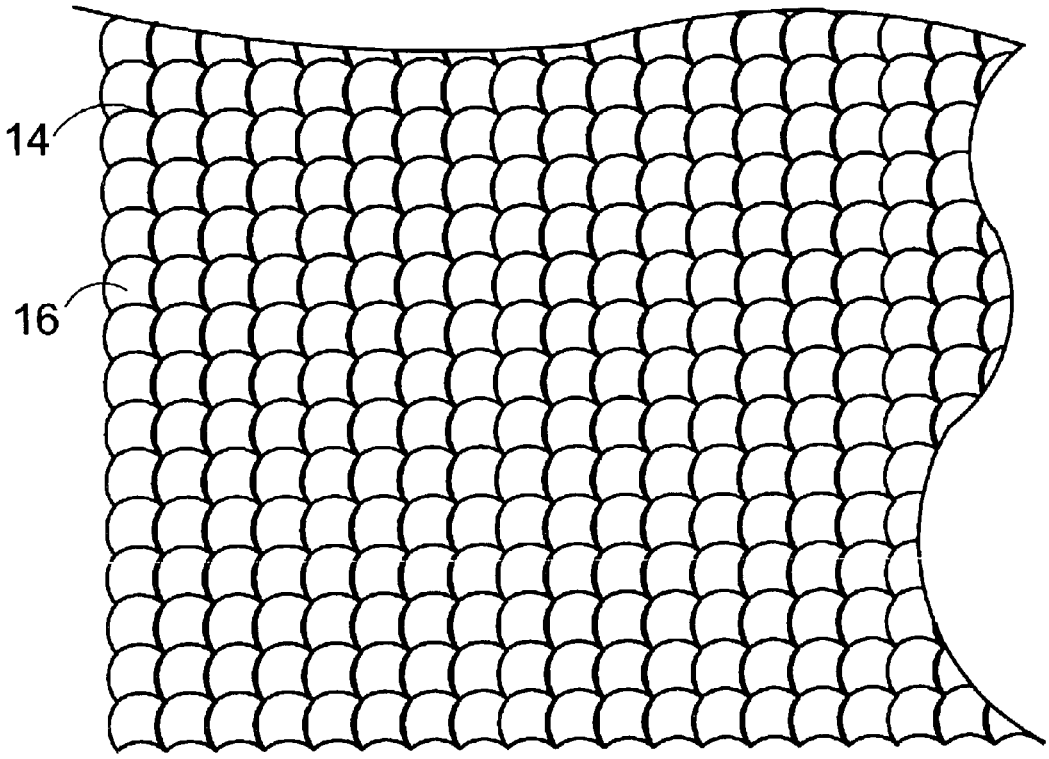
FIG. 6 is a top view of the of the hydraulic lift columns of the reconfigurable maze of the present invention.

FIG. 6 is a top view of a section of the maze columns 16 of the present invention. The columns 16 are kept stable by the steel floor grid 14. The pattern of the maze can be changed to a different configuration by a computer 60 that controls the operation of the hydraulic lifts 26 as illustrated in FIG. 11.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 7:
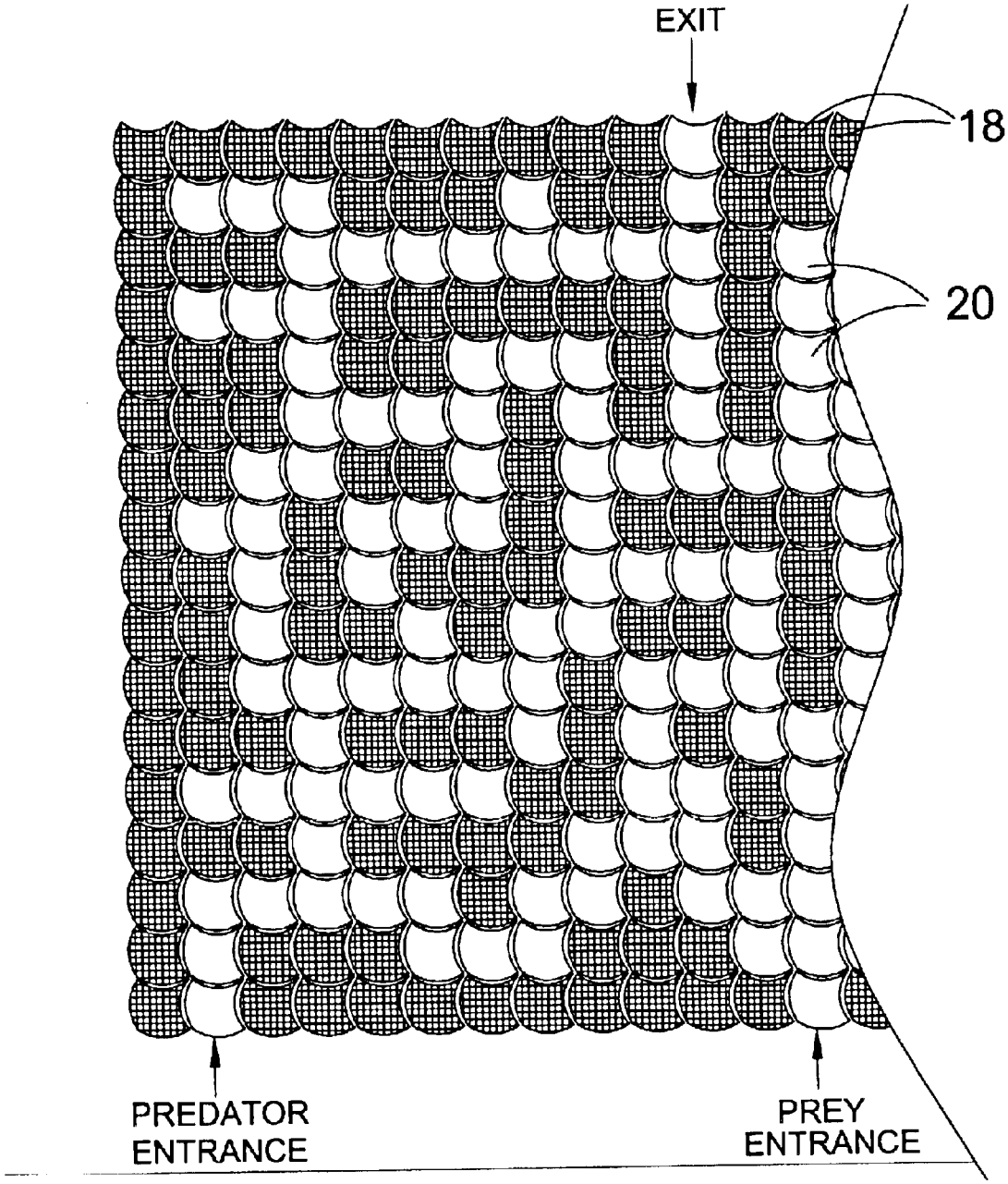
FIG. 7 is a top view of a maze formed from the hydraulic lift columns of the reconfigurable maze of the present invention.

FIG. 7 is a top view of a section of the maze columns 16 of the present invention, illustrating one possible maze pattern. The columns 16 are kept stable by the steel floor grid 14. The pattern of the maze can be selectively changed to have a different configuration. The maze is reconfigurable using a computer 60 that controls the operation of the hydraulic lifts 26.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 8:
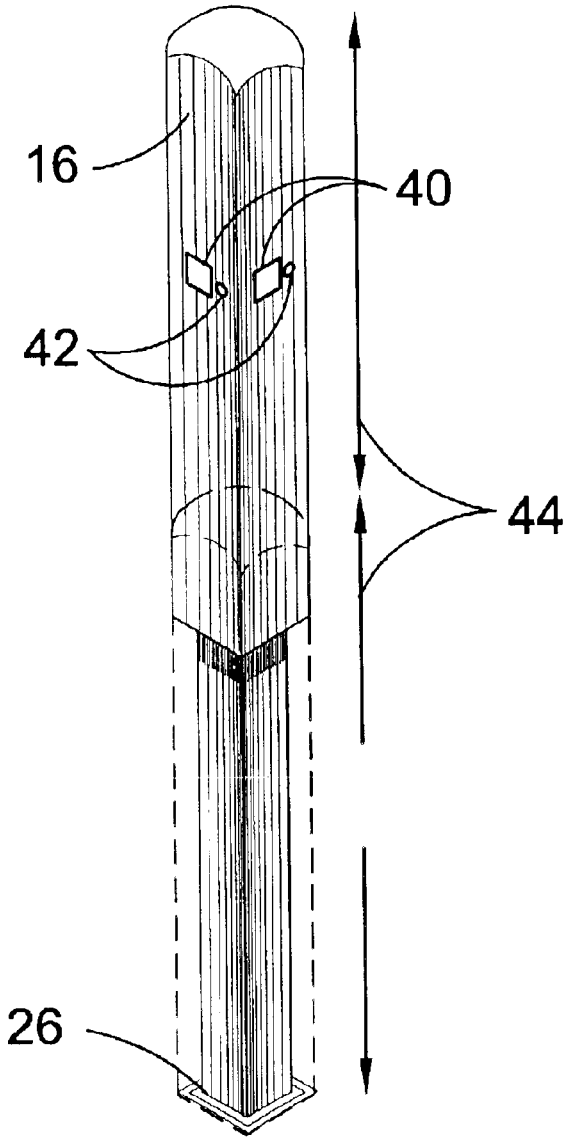
FIG. 8 is a perspective view showing movement of a single hydraulic lift column of the reconfigurable maze of the present invention in a raised position.

FIG. 8 is a perspective view of a column 16 and hydraulic lift 26 of the present invention. Shown is a perspective view of a movable maze column 16 of the present invention. The column is shown 16 in solid line indicating the raised position and in dashed line indicating the lowered position. Directional lines 44 indicate the direction of movement of column 16 along the hydraulic lift 26 as illustrated in FIG. 11.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 9:
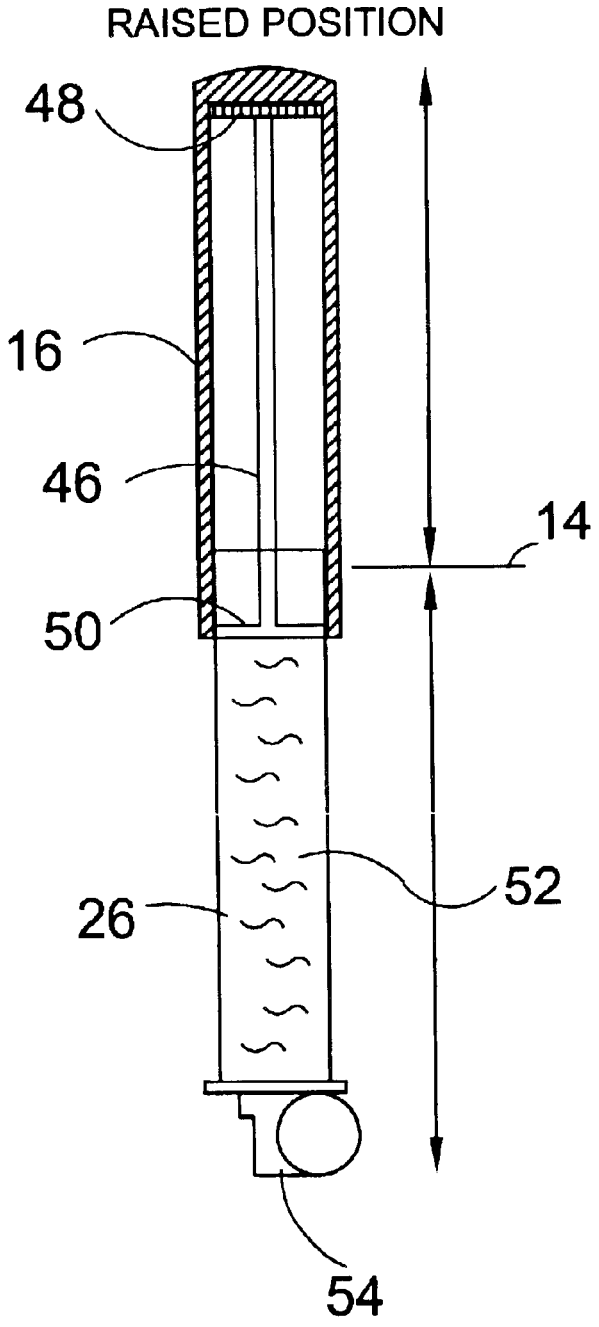
FIG. 9 is a cross-sectional view of a column and hydraulic lift column of the reconfigurable maze of the present invention in a raised position.

FIG. 9 is a sectional view of a column 16 and hydraulic lift 26 of the present invention, the hydraulic lift 26 includes a piston rod 46, two pistons 48 and 50, a fluid containing cylinder 52 and a computer controlled hydraulic pump 54. Shown is a cross-sectional view of the movable maze column 16 in a fully raised position.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

Figure 10:
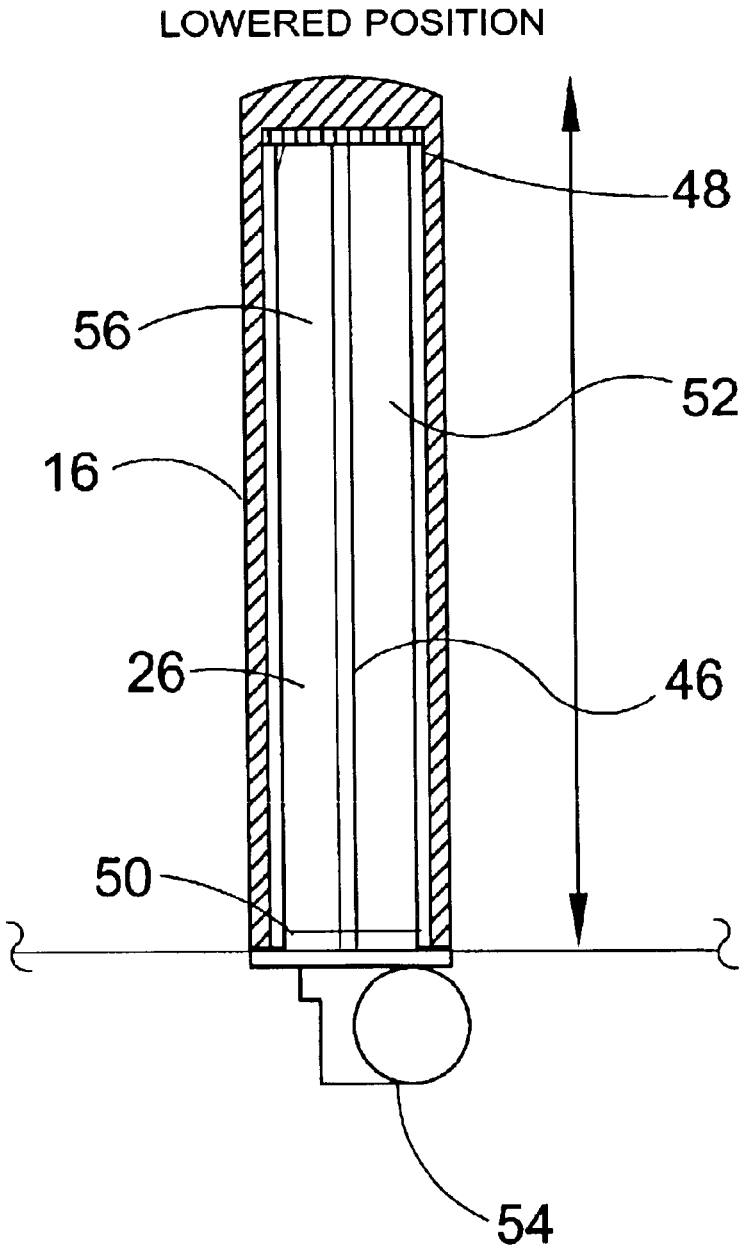
FIG. 10 is a cross-sectional view of a column and hydraulic lift of the of the reconfigurable maze of the present invention in a lowered position.

FIG. 10 is a cross-sectional view of a movable maze column 16 of the present invention in a fully lowered position. Illustrated is a column 16 in a lowered position and the hydraulic lift 26. The hydraulic lift 26 includes of the piston rod 46, two pistons 48 and 50, a fluid containing cylinder 52 filled with fluid 56 and a computer controlled hydraulic pump 54.

The reconfigurable maze 10 of the present invention is contained within a steel infrastructure having a steel floor grid 14 comprised of steel columns 16. The steel columns 16 are selectively moved from a lowered position forming a floor 20 to a raised position forming walls 18. The columns 16 are selectively moved using a program of steps executed by a computing device 60, as illustrated in FIG. 11 of the present invention. When the columns are in the lowered position, they form the floor 20 of the maze 10. When the columns are in the raised position, they form the walls 18 of the maze 10.

When the steel columns 16 are moved into position for forming the walls 18, they are located within the main level 22. On an underside of the main level 22 is a lower level 24 housing the hydraulic lifts 26 that raise and lower the columns 16. A main computer 60 of the present invention, as illustrated in FIG. 11 controls operation of the hydraulic lifts 26. The computer 60 can control the hydraulic lifts 26 to change the design of the maze 10 to form any desired pattern, as well as changing the maze 10 as frequently as desired.

FIG. 11 is an illustrative view of a column 16, hydraulic lift 26 and computer control center 58 of the present invention. The hydraulic lifts 26 that operate the column walls 18 are controlled by a computer system 60 positioned within the computer control center 58. The computer system 60 is either manually controlled by an operator 62 or automatically controlled by pre-selected programs down loaded into the computer 60 to raise or lower columns 16 and thereby to change the configuration of the maze 10.

Figure 12:
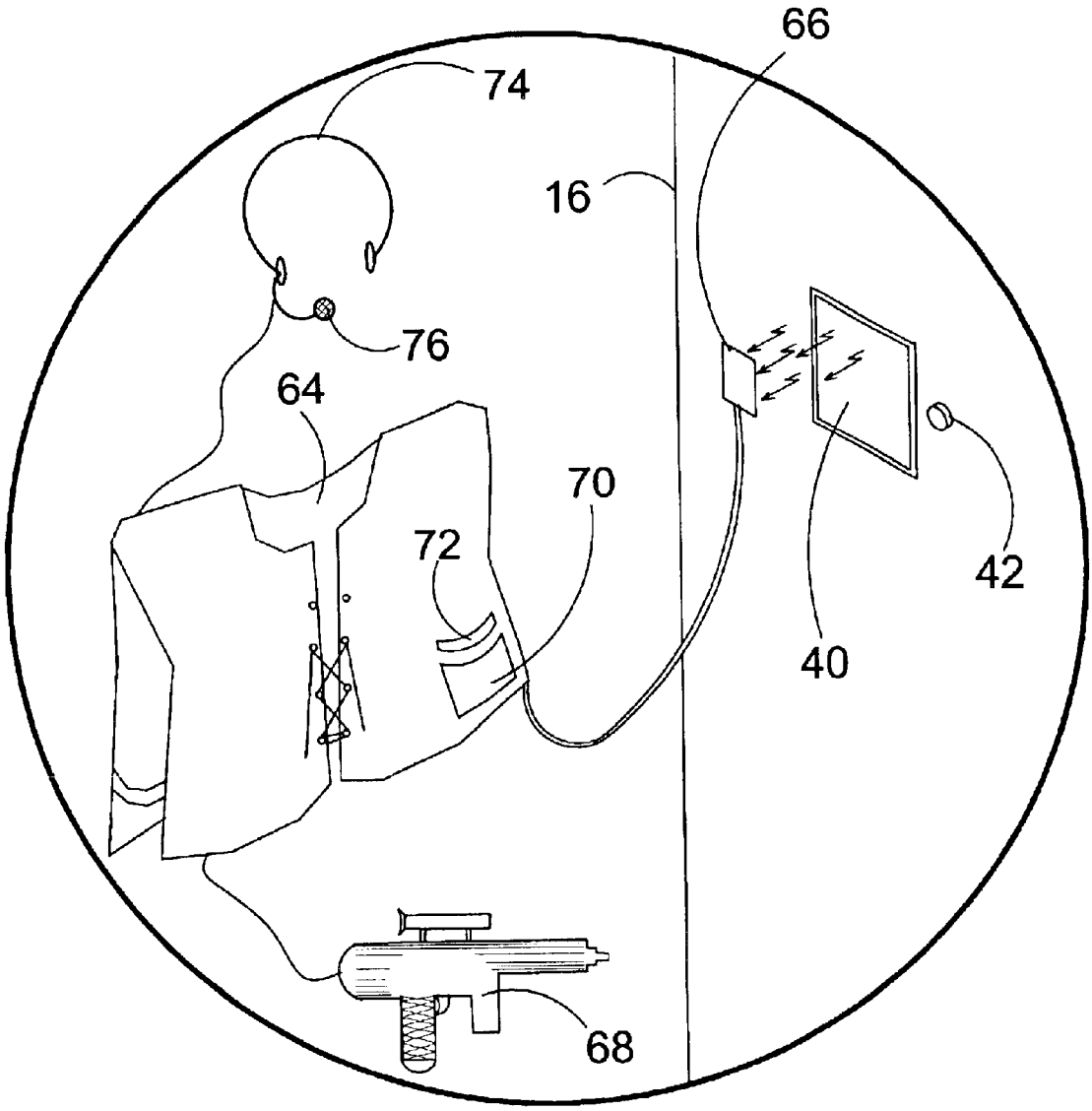
FIG. 12 is an illustrative view of the game gear for use with the of the reconfigurable maze of the present invention including electronic sensors.

The reconfigurable maze 10 may be utilized for numerous purposes. One of such uses includes games like hide and seek, paint-ball, laser-tag and many others. One game in particular, predator and prey, will be described below with reference to FIG. 12. FIG. 12 illustrates gear used in utilizing the reconfigurable maze 10 of the present invention to play a game. The gear includes a player's vest 64 and electronic sensor tag 66. The player presses the activation button 42 positioned on the column 16 along side the electronic points emitter 40 to gain points. Each column 16 may include four electronic points emitters, one on each of the four sides.

The Game

The objective of the predator and prey game is to generate points through finding check points including electronic points emitters 40 within a maze, seeking and tagging or shooting competitors using a laser gun 68, and completing and exiting the maze 10. A central computer 60 located in the computer control center 58 tracks the points generated by each player. Players may also be grouped into teams. The player or team that generates the most points over a defined period of time is deemed the winner.

At the beginning of each game the players are equipped with vests 64 including an attached laser gun 68 able to emit a unique infrared wave, a laser beam detector 70, an electronic sensor tag 66 able to receive a signed representation of points from the electronic points emitter 40 embedded within the column shaft 16, and a transmitter 72 for transmitting data signals including point information back to the central computer 60 to keep a record of points earned by each player.

The central computer 60 controls the game by activating the predator team's laser guns 68 and prey team's electronic sensor tags 66. In addition, the central computer maintains 60 the score by identifying the unique signal sent by each player.

The objective of the player or team of players defined as prey is to find electronic check points 40 within the maze. An electronic checkpoint is an identifiable object embedded in and illuminated on the columns' 16 vertical surface. Once an electronic checkpoint 40 is found, the player on the prey team activates the checkpoint by pressing a button 42. The checkpoint sends an infrared signal to the prey's sensor tag and, in turn, back to the central computer 40 awarding the player a set amount of points. The set amount of points may be pre-determined and modified by the operator 62.

An additional objective for the player or team of players designated as the prey team is to avoid being sought and "tagged" with the laser gun 68 of a player on the predator team or in the case of multiple teams participating on any other team. A player is "tagged" when their infrared sensor receives a signal from a laser gun. If a player is "tagged" with the infrared beam from the laser gun 68 of a predator player or player on another team, a signal is sent to the central computer 60. Once the player is tagged a predetermined number of times, the central computer deactivates that player's electronic sensor tag 66 for a set period of time. Hence during this period, the player is restricted from generating points.

A further objective of the player or team of players designated as prey is to complete and exit the maze 10. Once a player exits the maze 10, an electronic point emitter located outside the maze can be activated. The player presses the button 42 sending a signal to the sensor tag 66, in return the sensor tag 66 sends a signal to the central computer 60 to award a predetermined amount of points. Once players exits the maze they may reenter the maze by returning to and passing through the entrance 36 shown in FIG. 2. Upon reentering a player is able to earn more points by reactivating the electronic points emitters 40 inside the maze 10.

Figure 13:
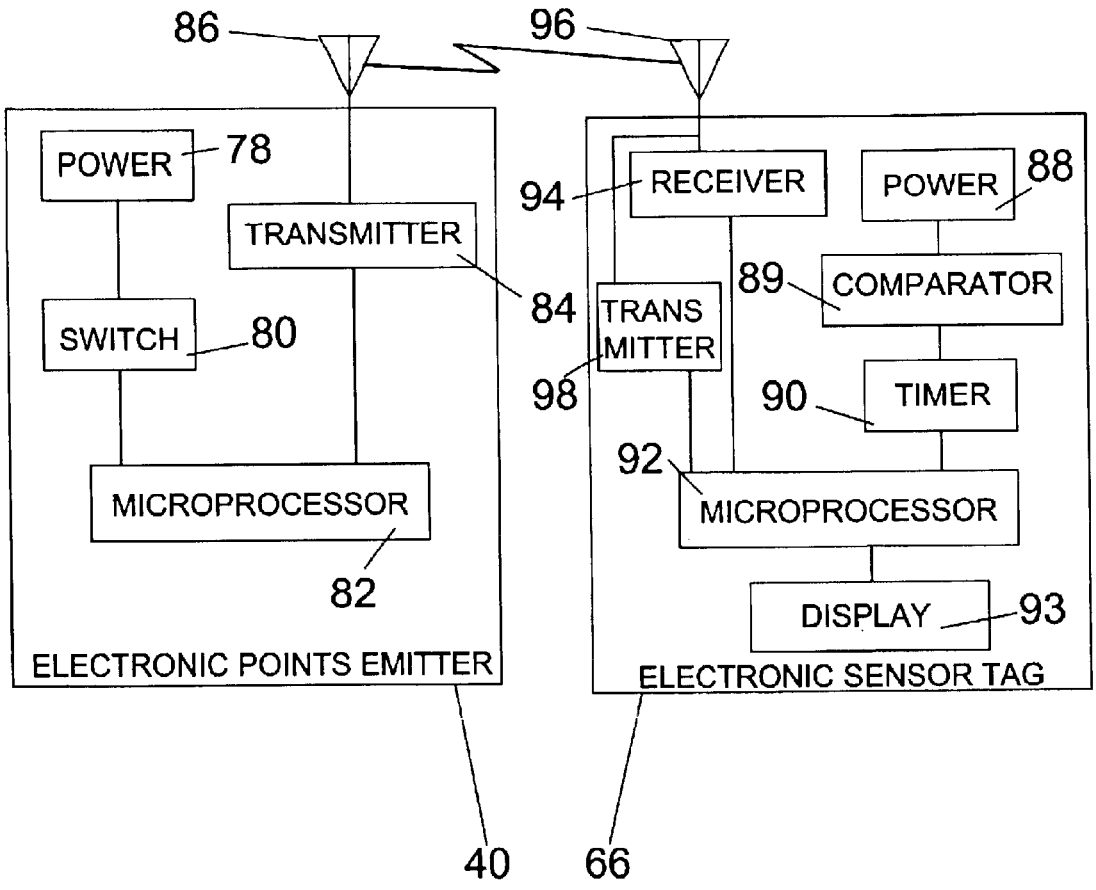
FIG. 13 is a block diagram of the communication apparatus for communicating between an electronics points emitter and the electronic sensor tag of the reconfigurable maze of the present invention.

FIG. 13 is a block diagram of the present invention showing the interaction of the electronic points emitter 40 and the electronic sensor tag 66. The player presses one of the switches 80 along side the electronic points emitter to gain points. As described above, each column 16 has four electronic points emitters 40, one on each of the four sides. Each electronic points emitter 40 includes a power module 78 connected through a switch 80 to a microprocessor 82. The microprocessor 82 is connected to a transmitter 84 and an antenna 86. The microprocessor 82 controls the transmitter 84 to transmit data signals via the antenna 86 to the electronic sensor tag 66.

Each electronic sensor tag 66 includes a power module 88 connected through a comparator 89 and timer 90 to a microprocessor 92 that in turn is connected to a display 93 and receiver 94. The receiver 94 is connected to an antenna 96. The microprocessor 92 processes the signals that the receiver 94 receives via the antenna 96 from the electronic points emitter 40 and displays the points received on the display 93. The electronic sensor tag 66 also includes a transmitter 98 for transmitting signals indicative of points earned to the central computer system 60.

Returning now to FIG. 12, an objective of the player or team of players designated as predator is to seek and "tag" a player or players assigned as either prey or predator of opposing teams with the laser gun 68. Once a signal transmitted by the player laser gun is received by the electronic receiver 66 of prey or predator player on an opposing team, a signal is transmitted to the central computer 60 and a predetermined amount of points are awarded to the predator.

An additional objective of the player or team of players designated as predator is to seek and tag players (prey or predator) of opposing teams with the laser gun 68 beam within a set amount of time. If the set amount of time elapses without the player generating a point, a signal is sent from the central computer 60 and the player predator laser gun 68 is deactivated for a set period of time.

A further objective of the player or team of players designated, as predator is to complete and exit the maze 10. Once a player exits the maze 10, a signal is transmitted to the central computer from his laser gun or sensor tag 66 and the player is awarded a predetermined amount of points whereupon a predator may reenter the maze through the entrance area and receive additional points.

The following is an example of a game to be played using the maze of the present invention. The game is preferably of a predetermined length of time that is divided into two equal time periods. After the first period of time, the players' objectives change. The predator becomes the prey, and the prey becomes the predator. This is done by activating the laser gun for the predators only and the sensor tag for preys only. Players or teams are identifiable by color-coded vests worn by the participants. Additional teams can be added whereby one teams game play overlaps another. The following is a description of a scenario involving color-coded teams. There may be two teams red prey and green predator that enter the maze. After a predetermined period of time, the red team becomes predator and the green team becomes prey. Along with the switch two new teams are added, yellow prey and blue predator. After a predetermined period of time, the red and green teams leave. The yellow team becomes predator and the blue prey. Along with the switch two new teams are added, orange prey and purple predator. And the cycle continues.

After each half, players who have completed their game are directed to the rest area outside the maze after the columns are lowered which allows players to exit the maze. To ensure safety players who are still in the game will then remain in the rest area while the maze walls are raised and the next session is ready to begin. The maze may then be redesigned for the next session. The previous discussion is only an example of one game that may be played using the reconfigurable maze of the present invention. In practice numerous other games with set rules may be played or the players may even make up their own rules as they play.

Another means for management and an audience to observe the game action is a promenade deck elevated above the maze. This observation area as shown in FIG. 1 is positioned directly above the rest area on the ground floor (which is made up of the maze area and the rest area).

An embodiment of the present invention includes the use of headphones 74 and microphones 76 by the participants. Such equipment can be used by game management to ensure the safety of the participants. In the event of distraught or distressed participant management will stop the game in progress and lower the maze. This is advantageous in that players do not have to be directed out of the maze, the maze may be lowered at any time. Safety during the lowering process is assured to the player by the removal of any loose articles before entering the maze and the assurance that the player is wearing appropriate gear. This equipment can also be beneficial to management in controlling unruly or unsafe conduct of participants.

Furthermore, headphones 74 and microphones 76 provide for improved verbal communications among team members and can provide sound effects as objectives are met or time penalties are awarded.

The role change and introduction of new participants proceeds as follows. When a session has ended the participants are asked to stop moving and instructed to move to the middle of the walkway as the walls are lowered. The participants are then directed to the rest area 28 shown in FIG. 2. Once cleared the maze area 38 is reconfigured and the walls 18 are erected and the teams are directed to the maze entrances 36 where play resumes.

From the above description it can be seen that the reconfigurable maze of the present invention is able to overcome the shortcomings of prior art devices by providing the maze structure consisting of two levels, the main recreation maze level and a lower level for housing the hydraulic lifts that raise and lower the column partitions of the maze. The hydraulic lifts are controlled by a main computer that can change the maze design to any conceived pattern, as frequently as desired.

The changing of the maze is accomplished by lowering certain column partitions and raising others. When the column partitions are not lifted, the hydraulic lift is at its lowest height and the top surface of the column partition, housed at the lower maze level, can safely serve as the floor at the second maze level. The column partitions serving to define the maze course create a plurality of interconnecting pathways along which movement of a person through the maze is restricted.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A reconfigurable maze comprising:

a plurality of columns arranged to form a grid; and a plurality of hydraulic lifts, each of said plurality of hydraulic lifts connected to move a respective one of said plurality of columns between a first raised position and a second lowered position wherein each of said plurality of columns in said second lowered position form a floor surface of said maze and each of said plurality of columns in said first raised position form walls said maze, said walls defining paths through said maze, and a housing for holding said columns in close proximity to each other thereby forming said grid, wherein said housing is made of steel.

2. The maze of claim 1, wherein each of said plurality of hydraulic lifts include a hydraulic pump for controlling movement of a respective column between said first raised position and second lowered position.

3. The maze of claim 2, wherein each of said plurality of hydraulic lifts further include a first piston, a second piston, and a piston rod connecting said first piston and second piston said piston rod being driven by a respective hydraulic pump to move said respective column between said first raised and second lowered positions.

4. The maze of claim 1, further comprising a control processor for selectively controlling each of said plurality of hydraulic lifts to move respective columns between said first raised position and said second lowered position.

5. The maze of claim 4, wherein each of said plurality of columns includes at least one electronic points emitter and at least one activation button wherein upon activation of said button said points emitter transmits a signal indicative of activation to said control processor.

6. The maze of claim 5, wherein said maze is used to play a game.

7. The maze of claim 6, further comprising electronic sensor equipment including a vest, an electronic sensor tag, and a laser gun wherein said electronic sensor equipment is worn by a user playing the game.

8. The maze of claim 7, further comprising a plurality of headphone sets and a plurality of microphones wherein each user wears a respective headphone set and microphone.

9. The maze of claim 8, wherein said electronic points emitter includes a power unit, a switch, a microprocessor, a transmitter and an antenna.

10. The maze of claim 9, wherein said electronic sensor tag includes a power unit, a comparator, a timer, a microprocessor, a receiver, an antenna and a display.

11. The maze of claim 4, wherein said control processor is manually controlled to select said plurality of columns to be moved into said first raised position and said plurality of columns to be moved into said second lowered position to thereby form a maze.

12. The maze of claim 1, wherein said housing includes a first level for holding said plurality of columns in said first raised position and a second level for holding said plurality of hydraulic lifts and said plurality of columns in said second lowered position.

* * * * *